US007670106B2

(12) United States Patent
Bouru

(10) Patent No.: US 7,670,106 B2
(45) Date of Patent: Mar. 2, 2010

(54) BUSHING FOR A VARIABLE-PITCH VANE PIVOT IN A TURBOMACHINE

(75) Inventor: Michel André Bouru, Montereau sur le Jard (FR)

(73) Assignee: SNECMA, Paris (FR)

( * ) Notice: Subject to any disclaimer, the term of this patent is extended or adjusted under 35 U.S.C. 154(b) by 694 days.

(21) Appl. No.: 11/492,781

(22) Filed: Jul. 26, 2006

(65) Prior Publication Data

US 2007/0025842 A1 Feb. 1, 2007

(30) Foreign Application Priority Data

Jul. 27, 2005 (FR) ..... 05 08000

(51) Int. Cl.
*F04D 29/56* (2006.01)

(52) U.S. Cl. ..... 415/160; 415/148

(58) Field of Classification Search ..... 415/160, 415/162, 163, 148

See application file for complete search history.

(56) References Cited

U.S. PATENT DOCUMENTS 5,796,199 A 8/1998 Charbonnel
5,893,446 A 4/1999 Honjo et al.
6,386,763 B1 5/2002 Mack et al.
7,278,719 B2 * 10/2007 Scardovi et al. ..... 347/85
7,360,990 B2 * 4/2008 Barbe et al. ..... 415/160
2002/0154991 A1 10/2002 Bowen

FOREIGN PATENT DOCUMENTS

FR 2 698 405 5/1994

* cited by examiner

*Primary Examiner*—Edward Look
*Assistant Examiner*—Dwayne J White
(74) *Attorney, Agent, or Firm*—Oblon, Spivak, McClelland, Maier & Neustadt, L.L.P.

(57) ABSTRACT

A bushing for a variable-pitch vane pivot in a turbomachine, the bushing being for mounting in a recess in a ring of the turbomachine, the recess being of a shape that is substantially complementary to the shape of the bushing, the bushing comprising a body that is substantially tubular having a longitudinal axis, and at least three branches extending radially outwards relative to the longitudinal axis of the tubular body, and axially over the full height of said tubular body, said branches being distributed in substantially equidistant manner around the circumference of the tubular body.

4 Claims, 5 Drawing Sheets

BUSHING FOR A VARIABLE-PITCH VANE PIVOT IN A TURBOMACHINE

BACKGROUND OF THE INVENTION

The present invention relates to the general field of variable-pitch vanes for a turbomachine, and more particularly to bushings for the guide pivots of such vanes.

The high pressure compressor of a gas turbine typically comprises a plurality of circular stages of vanes of orientation that can be adjusted so as to modify the flow characteristics of the gas, depending on the operating speeds of the turbomachine. These vanes are referred to as variable-pitch vanes.

Each variable-pitch vanes in a given stage has a control pivot at a radially-outer "head" end and a guide pivot at a radially-inner "foot" end. The control pivot passes through the stator casing of the turbomachine and co-operates with a control member. By acting on the control member, it is possible to modify the orientation of the vanes in the stage concerned. The guide pivot of each vane moves in a bushing that is mounted in a corresponding recess in an inner ring inside the turbomachine and centered on the longitudinal axis of the machine.

While assembling the vanes on the inner ring, it is important to ensure good centering of the guide pivot for the vanes. This centering is obtained by ensuring that the bushings and the recesses in the inner ring in which the bushings are mounted are accurately coaxial. The accuracy with which the vanes are centered must also be maintained regardless of the operating stage of the turbomachine. Unfortunately, techniques known in the prior art for mounting bushings in the inner ring do not include any particular arrangement for ensuring that the quality of centering is maintained. The centering of the vane guide pivot thus tends to become less good in operation, in particular when the bushings of the pivot support and the inner ring are made of materials that have different coefficient of thermal expansion.

OBJECT AND SUMMARY OF THE INVENTION

A main object of the present invention is thus to mitigate such drawbacks by proposing a bushing suitable for ensuring permanent quality for the centering of vane guide pivots, regardless of the operating stage of the turbomachine and independently of the materials used for making the bushing and the inner ring in which the bushing is mounted.

To this end, the invention provides a bushing for a variable-pitch vane pivot in a turbomachine, the bushing being for mounting in a recess in a ring of the turbomachine, the recess being of a shape that is substantially complementary to the shape of the bushing, the bushing comprising a body that is substantially tubular having a longitudinal axis, and further comprising at least three branches extending radially outwards relative to the longitudinal axis of the tubular body, and axially over the full height of said tubular body, said branches being distributed in substantially equidistant manner around the circumference of the tubular body.

The use of these branches that are distributed in equidistant manner around the circumference of the tubular body of the bushing makes it possible to ensure that the bushing is centered regardless of the operating temperature and regardless of the materials used for making the bushing and the inner ring.

In an embodiment of the invention, each branch presents a cross-section that is substantially rectangular. Preferably, each branch presents walls that are substantially parallel on either side of a longitudinal plane of symmetry of the branch.

In another embodiment of the invention, each branch is in the form of a tubular branch of cross-section that is substantially oval. The walls of the branches may be deformable, each wall of the branches then being for pressing against walls of the recess in the ring in which the bushing is to be mounted.

In yet another embodiment of the invention, each branch is provided with two deformable tongues extending along the longitudinal axis of the tubular body, each tongue being for folding down against walls of the recess in the ring in which the bushing is to be mounted.

Regardless of the embodiment, the bushing advantageously has at least four branches distributed in substantially equidistant manner around the circumference of the tubular body.

According to another particular characteristic of the invention, the bushing is made of a material having a coefficient of thermal expansion that is different from that of the ring in which it is to be mounted.

The invention also provides a turbomachine ring having a plurality of recesses, each serving to receive the guide pivot of a variable-pitch vane, the ring further comprising a plurality of bushings as defined above.

BRIEF DESCRIPTION OF THE DRAWINGS

Other characteristics and advantages of the present invention appear from the following description given with reference to the accompanying drawings which show an embodiment having no limiting character. In the figures.

DETAILED DESCRIPTION OF EMBODIMENTS

Figure 1:
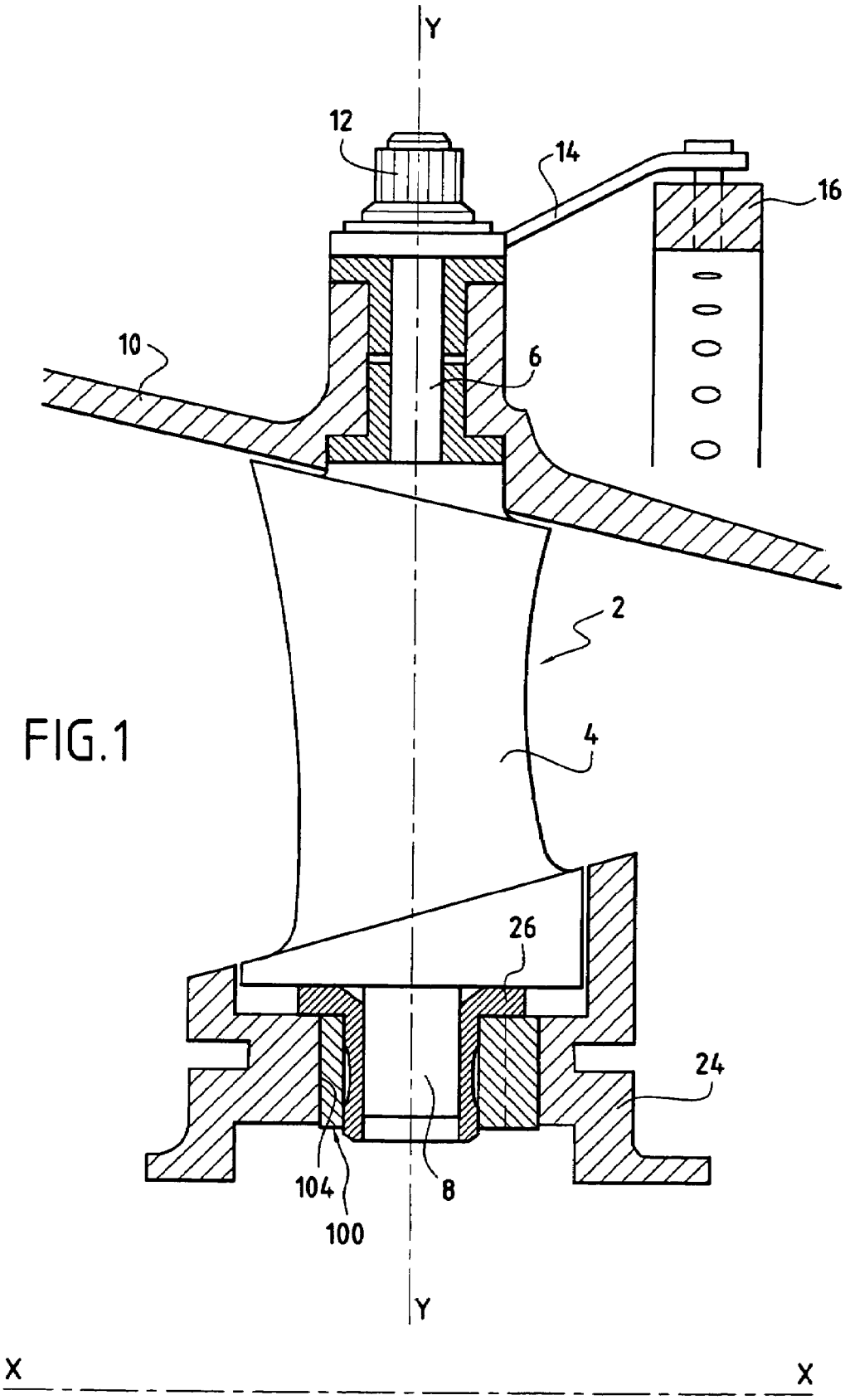
FIG. 1 is a section of a bushing of the invention in its environment.

With reference to FIG. 1, the variable-pitch vanes 2 of the high pressure compressor of the turbomachine are distributed in circular stages centered on the longitudinal axis X-X of the turbomachine and disposed between stages of moving blades (not shown) which are secured to a rotor of the turbomachine.

Each variable-pitch vane 2 of a circular stage extends along a main axis Y-Y in a radial direction relative to the longitudinal axis X-X of the turbomachine. The vane 2 is in the form of an airfoil 4 terminating at a radially outer end (or blade head) by a control pivot 6 (or top pivot), and at a radially inner end (or blade foot) by a guide pivot 8 (or bottom pivot).

The control pivot 6 of the variable-pitch vane 2, centered on its main axis Y-Y, passes through a tubular casing 10 of the turbomachine stator and co-operates with a control member for setting the angle of the blades. More precisely, the control pivot 6 of each vane 2 projects radially outwards from the stator casing 10 and is terminated by a head 12 having engaged thereon one end of a control rod 14 whose other end co-operates with a control ring 16 centered on the longitudinal axis X-X of the turbomachine.

The control rods 14 and ring 16 form the member for controlling the pitch angle of the vanes. Turning the control ring 16 about the longitudinal axis X-X of the turbomachine serves to turn the control rod 14 and thus to modify simultaneously the pitch angle of all of the variable-pitch vanes 2 in a given stage of the high pressure compressor.

The guide pivot 8 of the variable-pitch vane 2 centered on its main axis Y-Y is designed to pivot in a hollow bushing 100.

Each bushing 100 is mounted in a recess 104 formed in an inner ring 24 of the high pressure compressor of the turbomachine that is centered on the longitudinal axis X-X of the turbomachine, with the bushing and the recess being substantially complementary in shape.

Furthermore, as shown in FIG. 1, an additional bushing 26 in the form of a shrink-on band can be mounted tightly around each guide pivot 8 of a vane 2. Such an additional bushing 26 of substantially cylindrical shape is thus interposed between the guide pivot 8 of a vane and the corresponding bushing 100. It serves to avoid premature wear of the bushing.

Figure 2:
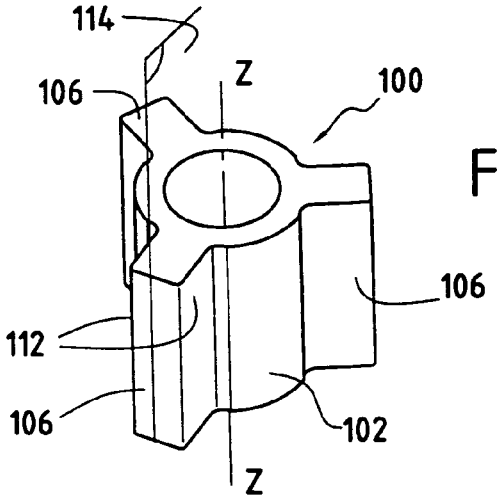
FIG. 2 is a perspective view of the FIG. 1 bushing.

As shown in FIG. 2, the bushing 100 presents a substantially tubular body 102 of longitudinal axis Z-Z that is to receive the guide pivot 8 of the vane.

According to the invention, in order to ensure that the bushing 100 is accurately centered relative to the recess 104 regardless of the operating temperature and the materials from which these parts are made, the bushing 100 has at least three branches 106 (or teeth or tabs) extending firstly radially outwards from the longitudinal axis Z-Z of the tubular body 102, and secondly axially over the entire longitudinal height of the tubular body (FIG. 2). The three branches 106 are also distributed in substantially equidistant manner around the entire circumference of the tubular body 102 of the bushing 100 (i.e. the angle between two adjacent branches is 120°).

Naturally, as explained above, the recess in which the bushing is mounted is of a shape that is substantially complementary thereto, i.e. it presents a central bore for passing the tubular body of the bushing, and three slots each receiving one of the branches.

The bushing 100 is thus centered in the recess 104 of the inner ring 24 by at least three guides that are radial (relative to the direction defined by the longitudinal axis X-X of the turbomachine) which guides are physically embodied by the three branches 106 of the bushing distributed in equidistant manner.

The bushing of the invention and the inner ring in which the bushing is to be mounted may be made of materials having coefficients of thermal expansion that are different. For example, the bushing can be made of steel while the inner ring is made of aluminum.

Various embodiments of the bushing of the invention are described below. In the embodiment shown in FIGS. 1 and 2, the bushing has three branches, whereas in the other embodiments the bushing is provided with four branches. Naturally, in all of these embodiments, the bushing may have some other number of branches, providing the number is not less than three and the branches satisfy the characteristics specified above.

In a first embodiment of the bushing of the invention, as shown in FIGS. 1 to 4, each branch of the bushing presents a cross-section that is substantially rectangular and has walls that are substantially parallel relative to a longitudinal plane of symmetry of the branch.

Thus, in the embodiment of FIG. 2, the bushing 100 is provided with three branches 106, each having a rectangular cross-section and walls 112 that are parallel to each other on either side of a longitudinal plane of symmetry 114 of the branch.

Figure 3:
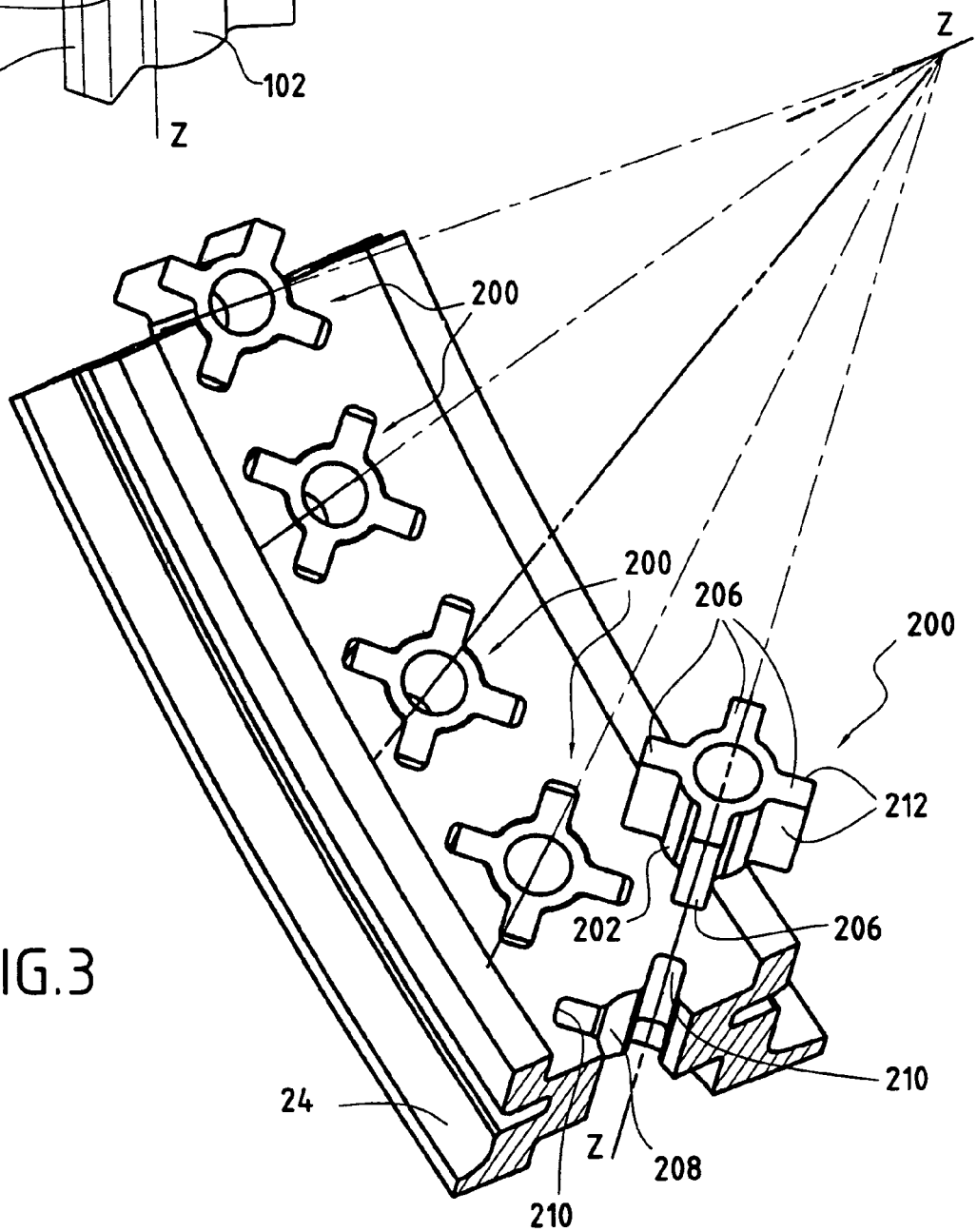
FIG. 3 is a perspective view of bushings mounted on a ring showing a variant of the embodiment shown in FIG. 2.
Figure 4:
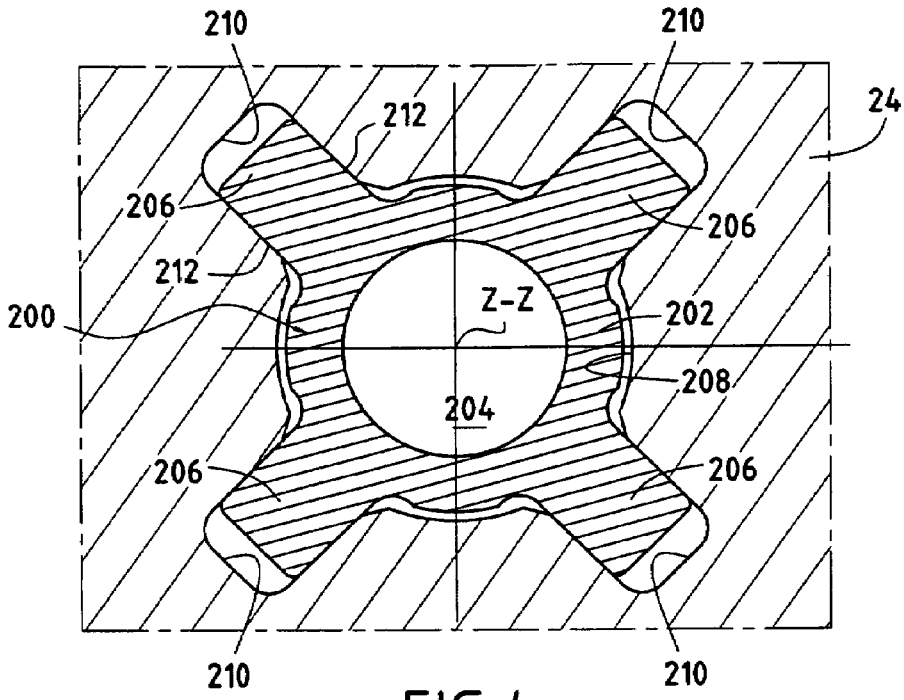
FIG. 4 is an end view of the FIG. 3 bushing.

In a variant of this first embodiment, as shown in FIGS. 3 and 4, the bushing 200 has four branches 206 distributed in equidistant manner around the entire circumference of the tubular body 202 (i.e. the angle between two adjacent branches is 90°).

Furthermore, each of the four branches 206 of the bushing 200 in this variant embodiment presents a rectangular cross-section and has walls 212 that are parallel to each other on either side of a longitudinal plane of symmetry (not shown in the figures for reasons of clarity).

As shown in FIG. 4, the particular shape of the bushing 200 of this first embodiment serves to obtain a quality of fit on assembly between the branches 206 and the equivalent slots 210 of the recess 204 of the inner ring 24 that is equivalent to the fit that would be required for conventional accurate centering. By way of example, the centering may be of the H7g6 type as specified in the AFNOR Standard for mutual fitting of two parts (where AFNOR is the French Standards Body).

Furthermore, this quality of fit does not deteriorate in operation, i.e. when the temperature of the two parts rises, even when the parts are made of materials having different coefficients of thermal expansion. There is also a small amount of clearance between the central bore 208 of the recess 204 and the tubular body 202 of the bushing. When cold, this clearance may be of the order of about 0.2 millimeters (mm), for a bushing having a tubular body with an outside diameter of 9 mm.

It should be observed that the rectangular cross-section branches 106, 206 of the bushings 100, 200 in this first embodiment of the invention also ensure that the bushing does not turn in its recess 104, 204.

In a second embodiment of the bushing of the invention, as shown in FIGS. 5, 6, 7A, and 7B, each branch is in the form of a tubular branch of cross-section that is substantially oval.

Figure 6:
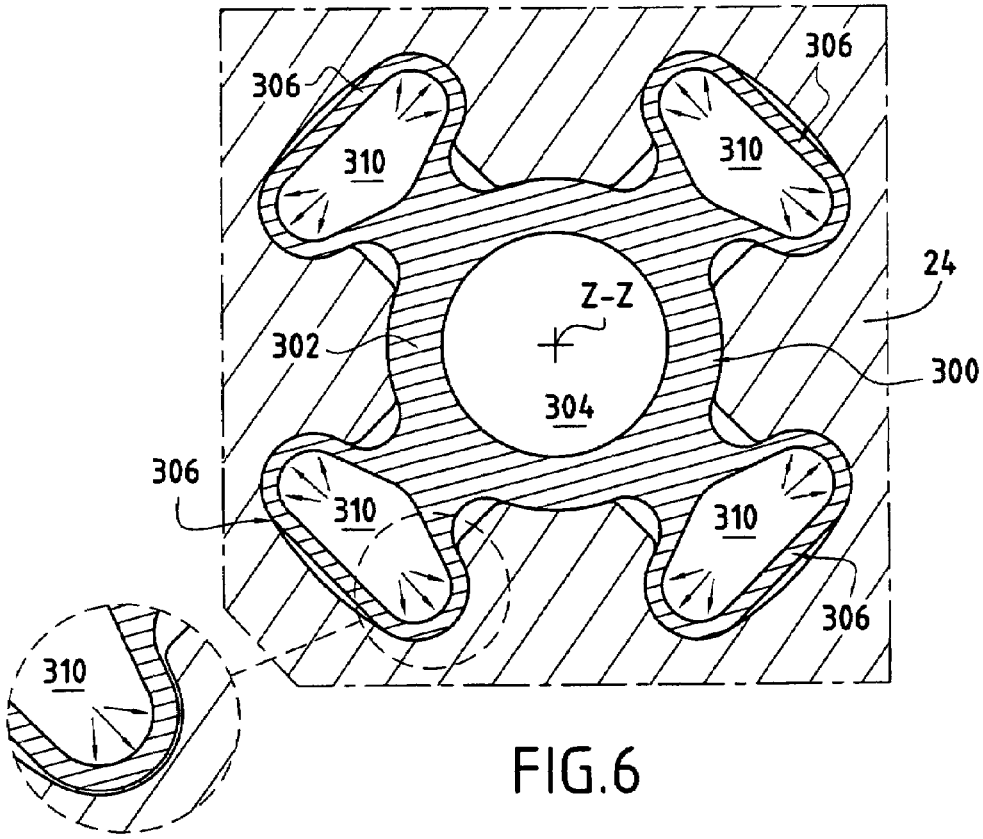
FIG. 6 is an end view of the FIG. 5 bushing.
Figure 5:
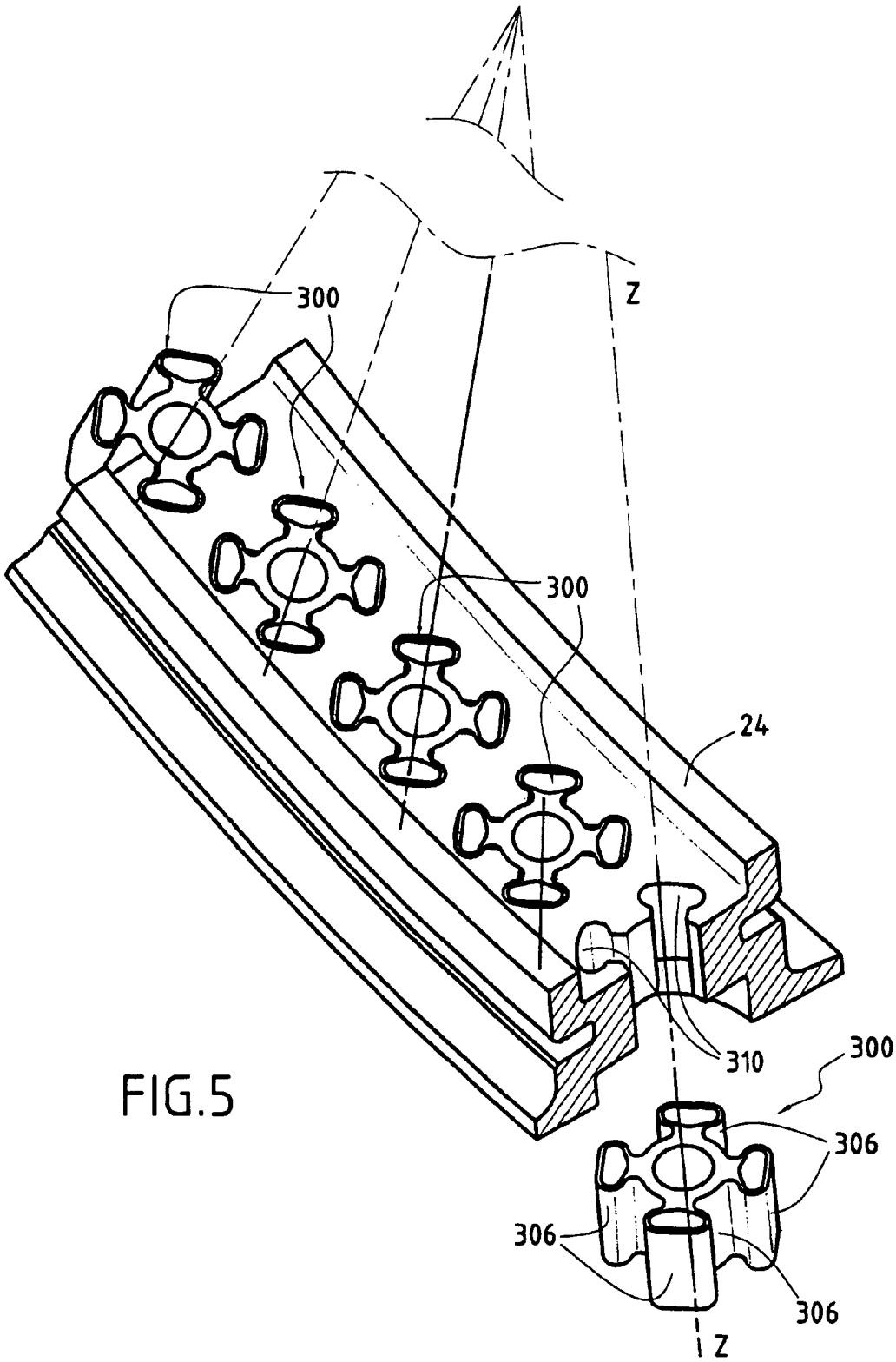
FIG. 5 is a perspective view of bushings mounted in a ring in another embodiment of the invention.

Thus, in the embodiment of FIGS. 5 and 6, the bushing 300 has four tubular branches 306 distributed in equidistant manner around the circumference of the tubular body 302 of the bushing, each branch having a cross-section that is substantially oval.

As shown in FIG. 6, while the bushing 300 is being mounted in the recess 304 of the inner ring 24, a small amount of clearance exists between the slots 310 of the recess and the tubular branches 306 of the bushing. By applying a force, e.g. by injecting a fluid under pressure into the tubular branches 306, the walls of these branches are caused to bear against the walls of the recess in the inner ring, thereby taking up this clearance, as represented by arrows in FIG. 6. It is thus possible to ensure that the bushing is accurately concentric in the recess of the inner ring as soon as the temperature of these two parts rises.

As for the above-described first embodiment, the special shape of the bushing 300 also serves to ensure that it cannot turn in its recess 304.

Figure 7A:
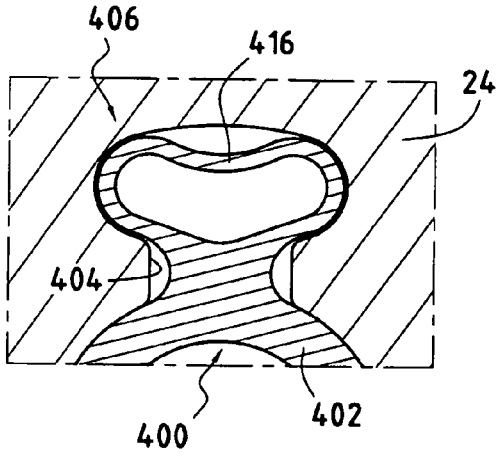
FIGS. 7A and 7B are fragmentary views of a bushing mounted in a ring in a variant of the embodiment of the bushing shown in FIG. 6.
Figure 7B:
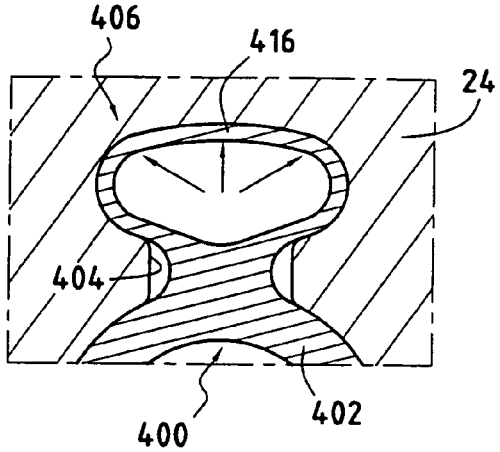

In a variant of this second embodiment, as shown in FIGS. 7A and 7B, the bushing 400 comprises a tubular body 402 and four tubular branches 406 (only one of the branches is shown in these figures). Furthermore, each tubular branch 406 of the bushing presents a cross-section that is substantially oval, and is it deformable.

More precisely, as shown in FIG. 1A, the wall defined by each tubular branch 406 of the bushing 400 presents a setback 416 going towards the inside of the branch in order to make it easier to mount the bushing in the recess 404. By means of an appropriate mechanical system, e.g. by injecting a liquid or a gas into the inside of the tubular branches, it is then possible to deform the setback 416 in the wall of each branch 406 in an outward direction (FIG. 7B). As a result, the wall defined by each branch of the bushing comes to press snugly against the outlines of the recess 404 in which the bushing is mounted, thus ensuring that the bushing is accurately concentric inside the recess in the inner ring.

Figure 8:
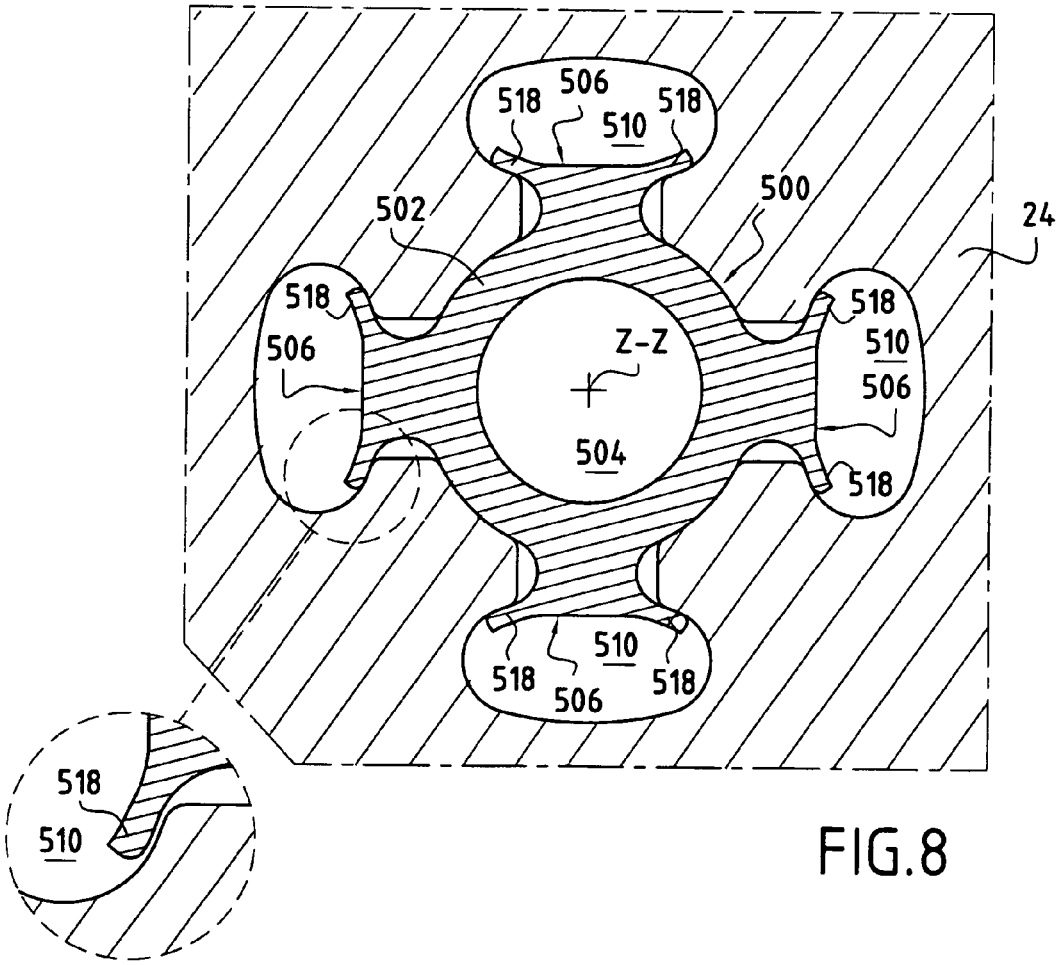
FIG. 8 is an end view of a bushing mounted in a ring and constituting yet another embodiment of the invention.

In yet another embodiment of the invention, as shown in FIG. 8, the bushing 500 comprises a tubular body 502 and four branches 506. Each branch 506 of the bushing is also provided with two deformable tongues 518 extending along the longitudinal axis (Z-Z) of the tubular body 502, each tongue being for folding down against the walls of the slots 510 of the recess 504 in the inner ring 24 in which the bushing is to be mounted.

What is claimed is:

1. A turbomachine comprising a ring including a plurality of recesses each for receiving a guide pivot of a variable-pitch vane, the ring further including a plurality of bushings, each mounted in one of said recesses, each of said recesses being of a shape that is substantially complementary to the shape of the bushing, each bushing comprising a body that is substantially tubular having a longitudinal axis, and further comprising at least three branches extending radially outwards relative to the longitudinal axis of the tubular body, and axially over the full height of said tubular body, said branches being distributed in substantially equidistant manner around the circumference of the tubular body, wherein each branch is in the form of a tubular branch of cross-section that is substantially oval.

2. A turbomachine according to claim 1, wherein walls of the branches are deformable, each wall of the branches pressing against walls of the recess in the ring in which the bushing is mounted.

3. A turbomachine according to claim 1, wherein each bushing has at least four branches distributed in substantially equidistant manner around the circumference of the tubular body.

4. A turbomachine according to claim 1 wherein each bushing is made of a material having a coefficient of thermal expansion that is different from that of the ring in which the bushings are mounted.

* * * * *